US006539673B1

(12) United States Patent
Ketonen

(10) Patent No.: US 6,539,673 B1
(45) Date of Patent: Apr. 1, 2003

(54) FIREPROOFING FOR AN ELEVATOR LANDING DOOR

(75) Inventor: Ari Ketonen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 09/711,304

(22) Filed: Nov. 14, 2000

Related U.S. Application Data

(63) Continuation of application No. PCT/FI99/00408, filed on May 12, 1999.

(30) Foreign Application Priority Data

May 14, 1998 (FI) ..... 981081

(51) Int. Cl.[7] ..... B66B 1/00
(52) U.S. Cl. ..... 52/30; 52/29; 52/232
(58) Field of Search ..... 52/30, 29, 212, 52/232; 187/336, 340

(56) References Cited

U.S. PATENT DOCUMENTS 3,921,346 A * 11/1975 Sauer et al. ..... 52/30
4,530,189 A 7/1985 Randall
5,156,237 A 10/1992 Hayashi et al.
5,293,962 A 3/1994 Pelvilaim
5,425,207 A * 6/1995 Shayman ..... 52/795
5,426,908 A * 6/1995 Shayman ..... 52/795
5,454,449 A * 10/1995 Makimattila et al. ..... 187/401
5,673,770 A * 10/1997 Friedman ..... 187/333
5,924,589 A * 7/1999 Gordon ..... 220/23.91
5,984,126 A * 11/1999 Gordon ..... 220/62.22
6,060,002 A * 5/2000 Ishikawa ..... 252/607
6,228,914 B1 * 5/2001 Ford et al. ..... 524/124

FOREIGN PATENT DOCUMENTS

CA 569891 2/1959

* cited by examiner

*Primary Examiner*—Carl D. Friedman
*Assistant Examiner*—Jennifer I. Thissell
(74) *Attorney, Agent, or Firm*—Birch, Stewart, Kolasch & Birch, LLP

(57) ABSTRACT

Fireproofing arrangement for an elevator landing door includes a skin plate facing toward the landing and a steel section reinforcement laid in the vertical direction of the door and attached to the skin plate. The surface of the steel section reinforcement on the side facing toward the shaft is provided with a layer of paint which becomes foamy when exposed to heat.

31 Claims, 1 Drawing Sheet

FIREPROOFING FOR AN ELEVATOR LANDING DOOR

This application is a Continuation of PCT International Application No. PCT/FI99/00408 filed on May 12, 1999, which designated the United States and on which priority is claimed under 35 U.S.C. § 120, the entire contents of which are hereby incorporated by reference.

FIELD OF THE INVENTION

The present invention relates to a fireproofing arrangement for an elevator landing door.

DESCRIPTION OF THE RELATED ART

Elevator doors are generally manufactured from non-combustible materials. Although they cannot catch fire, additional thermally insulating and fire retarding materials are generally used in them, in the first place to obstruct the propagation of fire and emergence of flames and to give more time for people to escape.

In practice, fire resistance of a door means a partitioning capacity. Partitioning is a central concept in fire technical design of buildings. Partitioning is used to restrict a fire that has already broken out so as to contain it within a certain area for a required length of time to allow time for rescue and firefighting efforts and to avoid unnecessary damage.

The door panels of an elevator door are generally provided with a layer of mineral wool on the shaft-side face of the metal plate forming the door surface on the side facing toward the landing, the door panel having a total thickness of e.g. about 20–30 mm. However, the door panel has to be provided with steel section reinforcements to stiffen the door panel. The steel section reinforcement is of a thickness substantially equal to that of the door panel, so it forms an effective heat transfer path through the insulating layer.

The faster door panel could be provided with additional insulation on the steel section reinforcement on the shaft-side surface as there is sufficient space for it, whereas no such space is available on the slower door panel as the faster door panel moves in direct contact with the surface of the insulation on the slower door panel.

To eliminate these problems, the landing-side surface the skin plate of at least the slower door panel is treated with flame-proofing paint, i.e. a substance that, when exposed to heat, expands and forms foamy insulating material. This insulation is intended to prevent the main steel structure of the door from being heated and to stop heat transfer via the heat transfer path formed by the reinforcing steel section.

However, this prior-art structure has obvious drawbacks. As the flame-proofing paint is visible on the surface of the skin plate and is therefore exposed to touch and wear, it is unlikely to remain completely intact and retain a uniform thickness through the years, as is required of high-quality fire insulation. In addition, in a fire situation, flames at the landing will come in direct contact with the paint layer, most fireproofing paints being combustible. Thus, in the event of a fire, they quickly lose their efficiency and functionality as a fireproofing or fire retarding structure.

BRIEF SUMMARY OF THE INVENTION

The object of the present invention is to eliminate the above-mentioned drawbacks. A specific object of the present invention is to disclose a new type of fireproofing, arrangement for an elevator landing door that is reliable and endures for years.

In the fireproofing arrangement for an elevator landing door according to the present invention, the landing door comprises a skin plate facing toward the landing and a steel, section reinforcement laid in the vertical direction of the door and attached to the skin plate.

According to the invention, the shaft-side surface of the reinforcing steel section is provided with a layer of fireproofing paint, i.e. paint that becomes foamy when heated. Thus, the invention is based on the new basic idea that the door is only designed to stop the propagation of heat beyond the door, without regard to the steel structure of the door itself becoming heated. Thus, the fireproofing paint can be applied to the shaft-side surface of the door so that it remains out of sight and is not exposed to touch and wear but is preserved unchanged.

The foaming fireproofing paint can be applied directly to the shaft-side surface of the reinforcing steel section. Another possibility is to attach a separate plate to the shaft-side surface of the reinforcing steel section e.g. by means of screws and then treat the surface of this plate with foaming paint.

The door is preferably provided with thermal insulation placed on the shaft-side surface of the skin plate. In this case, the reinforcing steel section preferably extends through the thickness of the thermal insulation.

The reinforcing steel section may comprise a shaft-side surface which is substantially parallel to the skin plate and to which the fireproofing paint is applied. This surface may be substantially flush with the shaft-side surface of the rest of the thermal insulation of the door.

In an embodiment of the invention, the steel section reinforcement consists of a box in which the reinforcing plate formed by the shaft-side surface is connected to the skin plate of the door e.g. by oblique side plates so that the cross-section of the reinforcement is a trapezoid tapering toward the shaft. In this case, fireproofing paint can also be applied to the side plate surfaces facing obliquely toward the shaft. It is also possible to use fireproofing paint on the other surfaces of the steel section reinforcement as well, i.e. on the surfaces facing e.g. squarely or obliquely toward the skin plate.

In an embodiment of the invention, fireproofing paint is applied to the entire shaft-side surface of the skin plate, whereupon thermal insulation can be mounted on it or it may be left without insulation.

As compared with prior art, the fireproofing arrangement of the present invention has significant advantages. The fireproofing can be so placed on the landing door that it remains out of sight and is therefore not susceptible to wear. Thus, the fireproofing is preserved intact and in good working order for a long time. Furthermore, in fire situations, the fireproofing paint will not come into direct contact with flames but only into thermal contact via steel structures, so it will be preserved unburned and function as insulation for a considerably longer period than the fireproofing paints used in current solutions.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention will be described in detail by referring to the attached drawing, which presents a cross-section of a fireproofing arrangement on an elevator landing door according to the invention.

DETAILED DESCRIPTION OF THE INVENTION

Figure 1:
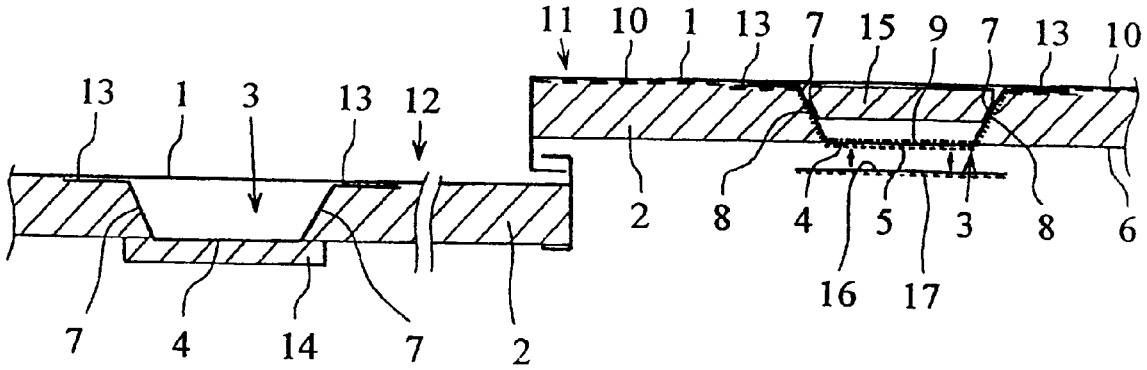

In the embodiment in FIG. 1, the slow door panel 11 and the fast door panel 12 have an identical basic structure. They comprise a skin plate 1 generally made of steel, placed on the side of the door facing toward the landing. Attached by its flanges 13 to the shaft-side surface of the skin plate 1 is a steel section reinforcement 3, which consists of a reinforcing plate 4 parallel to the skin plate 1 and oblique side plates 7. Both door panels are provided with thermal insulation 2 placed on the side of the skin plate 1 facing toward the shaft, the thickness of the insulating layer being substantially the same as the thickness of the steel section reinforcement 3. The faster door panel 12 is provided with additional insulating material 14 in the area of the steel section reinforcement 3. The additional insulation prevents thermal leakage through the steel section reinforcement from the landing to the shaft.

In the slower door panel 11, additional insulation 15 can be used inside the steel section reinforcement 3 to reduce thermal leakage through the reinforcement. However, it does not significantly prevent thermal leakage through the slower door panel. The slower door panel 11 cannot be provided with the type of insulation 14 used on the faster door panel 12 because the door panels travel at an almost zero distance from each other, leaving no space for such insulation.

To avoid thermal leakage through the steel section reinforcement 3 from the landing into the shaft, the shaft-side outer surface of the reinforcing plate 4 is coated with fireproofing paint 5, i.e. with a layer of paint that becomes foamy when exposed to heat. It is also possible to extend the layer of fireproofing paint so as to form paint layers 8 covering the shaft-side oblique surfaces of the side plates 7 of the steel section reinforcement 3.

If the insulating effect of the fireproofing paint is to be further enhanced, then a layer of paint 9 becoming foamy when exposed to heat can also be applied to the landing-side surface of the reinforcing plate 4, and similarly the landing-side surfaces of the skin plate 1, and of the reinforcement 3 flanges 13 attached to it can be provided with a layer of paint 10 becoming foamy when exposed to heat.

As an alternative structure, FIG. 1 shows a plate 16 provided with a layer of paint 17 becoming foamy when exposed to heat, which plate can be attached e.g. with screws to the shaft-side surface of the steel section reinforcement 3 instead of applying a layer such paint directly to that surface.

Of course, the fast door panel 12 may also be provided with a layer of foaming paint according to the present invention, especially when no heat insulation is used in either one of the door panels.

The fireproofing paints, i.e. the layers of paint becoming foamy when exposed to heat, used in the invention may consist of various known products applicable for this use, which will not be described in detail in this application.

The invention has been described above by way of example by referring to the attached drawing, but different embodiments of the invention are possible within the scope of the inventive idea defined in the claims.

What is claimed is:

1. An elevator landing door fireproofing arrangement, the landing door being positioned between a landing and a shaft, the landing door comprising:

a skin plate facing toward the landing; and a steel section reinforcement extending in a vertical direction of the door, the reinforcement being attached to the skin plate and a surface of the reinforcement on a side facing toward the shaft being provided with a layer of paint which becomes foamy when exposed to heat, the layer of paint only being on the surface of the steel section reinforcement facing toward the shaft.

2. The fireproofing arrangement as defined in claim 1, further comprising thermal insulation provided on a side of the skin plate facing toward the shaft while the steel section reinforcement extends substantially through a thickness of the thermal insulation.

3. The fireproofing arrangement as defined in claim 1, wherein the layer of paint is on a plate attached to or supported by the surface of the steel section reinforcement on the side facing toward the shaft.

4. The elevator landing door fireproofing arrangement, the landing door being positioned between a landing and a shaft, the landing door comprising:

a skin plate facing toward the landing; and a steel section reinforcement extending in a vertical direction of the door, the reinforcement being attached to the skin plate and a surface of the reinforcement on a side facing toward the shaft being provided with a layer of paint which becomes foamy when exposed to heat, the layer of paint being on a plate attached to or supported by the surface of the steel section reinforcement on the side facing toward the shaft, a side of the plate facing the landing being without the layer of paint.

5. The fireproofing arrangement as defined in claim 1, wherein the surface of the steel section reinforcement facing toward the shaft is substantially parallel to the skin plate.

6. The fireproofing arrangement as defined in claim 1, wherein the surface of the steel section reinforcement facing toward the shaft is substantially flush with a surface of the thermal insulation facing toward the shaft.

7. The fireproofing arrangement as defined in claim 1, wherein the steel section reinforcement includes a box in which a reinforcing plate is provided on the shaft side surface and in which oblique side plates are connected to the skin plate.

8. The fireproofing arrangement as defined in claim 7, wherein the layer of paint which becomes foamy when exposed to heat is provided on surfaces of the side oblique plates obliquely facing toward the shaft.

9. The fireproofing arrangement as defined in claim 7, wherein the layer of paint which becomes foamy when exposed to heat is provided on a surface of the reinforcing plate facing toward the skin plate.

10. The fireproofing arrangement as defined in claim 7, wherein the layer of paint which becomes foamy when exposed to heat is provided on a surface of the skin plate facing toward the shaft.

11. The fireproofing arrangement as defined in claim 1, wherein the layer of paint fails to completely cover the landing door.

12. The fireproofing arrangement as defined in claim 4, further comprising thermal insulation provided on a side of the skin plate facing toward the shaft while the steel section reinforcement extends substantially through a thickness of the thermal insulation.

13. The fireproofing arrangement as defined in claim 4, wherein the layer of paint is on a plate attached to or supported by the surface of the steel section reinforcement on the side facing toward the shaft.

14. The fireproofing arrangement as defined in claim 4, wherein the surface of the steel section reinforcement facing toward the shaft is substantially parallel to the skin plate.

15. The fireproofing arrangement as defined in claim 4, wherein the surface of the steel section reinforcement facing toward the shaft is substantially flush with a surface of the thermal insulation facing toward the shaft.

16. The fireproofing arrangement as defined in claim 4, wherein the steel section reinforcement includes a box in which a reinforcing plate is provided on the shaft side surface and in which oblique side plates are connected to the skin plate.

17. The fireproofing arrangement as defined in claim 4, wherein the layer of paint fails to completely cover the landing door.

18. The elevator landing door fireproofing arrangement, the landing door being positioned between a landing and a shaft, the landing door comprising:

a skin plate facing toward the landing; and a steel section reinforcement extending in a vertical direction of the door, the reinforcement being attached to the skin plate and a surface of the reinforcement on a side facing toward the shaft being provided with a layer of paint which becomes foamy when exposed to heat, the side of the skin plate facing toward the landing door being without the layer of paint.

19. The fireproofing arrangement as defined in claim 18, further comprising thermal insulation provided on a side of the skin plate facing toward the shaft while the steel section reinforcement extends substantially through a thickness of the thermal insulation.

20. The fireproofing arrangement as defined in claim 18, wherein the layer of paint is on a plate attached to or supported by the surface of the steel section reinforcement on the side facing toward the shaft.

21. The fireproofing arrangement as defined in claim 18, wherein the surface of the steel section reinforcement facing toward the shaft is substantially parallel to the skin plate.

22. The fireproofing arrangement as defined in claim 18, wherein the surface of the steel section reinforcement facing toward the shaft is substantially flush with a surface of the thermal insulation facing toward the shaft.

23. The fireproofing arrangement as defined in claim 18, wherein the steel section reinforcement includes a box in which a reinforcing plate is provided on the shaft side surface and in which oblique side plates are connected to the skin plate.

24. The fireproofing arrangement as defined in claim 18, wherein the layer of paint fails to completely cover the landing door.

25. The elevator landing door fireproofing arrangement, the landing door being positioned between a landing and a shaft, the landing door comprising:

a skin plate facing toward the landing; and a steel section reinforcement extending in a vertical direction of the door, the reinforcement being attached to the skin plate and a surface of the reinforcement on a side facing toward the shaft being provided with a layer of paint which becomes foamy when exposed to heat, a surface of the steel section reinforcement facing toward the landing being without the layer of paint.

26. The fireproofing arrangement as defined in claim 25, further comprising thermal insulation provided on a side of the skin plate facing toward the shaft while the steel section reinforcement extends substantially through a thickness of the thermal insulation.

27. The fireproofing arrangement as defined in claim 25, wherein the layer of paint is on a plate attached to or supported by the surface of the steel section reinforcement on the side facing toward the shaft.

28. The fireproofing arrangement as defined in claim 25, wherein the surface of the steel section reinforcement facing toward the shaft is substantially parallel to the skin plate.

29. The fireproofing arrangement as defined in claim 25, wherein the surface of the steel section reinforcement facing toward the shaft is substantially flush with a surface of the thermal insulation facing toward the shaft.

30. The fireproofing arrangement as defined in claim 25, wherein the steel section reinforcement includes a box in which a reinforcing plate is provided on the shaft side surface and in which oblique side plates are connected to the skin plate.

31. The fireproofing arrangement as defined in claim 25, wherein the layer of paint fails to completely cover the landing door.

* * * * *